US007870901B2

(12) United States Patent
Norris

(10) Patent No.: US 7,870,901 B2
(45) Date of Patent: Jan. 18, 2011

(54) INHIBITING FORMATION FACE FAILURE IN OIL AND GAS WELLS

(75) Inventor: Mark Norris, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 74 days.

(21) Appl. No.: 12/330,636

(22) Filed: Dec. 9, 2008

(65) Prior Publication Data

US 2009/0166039 A1 Jul. 2, 2009

Related U.S. Application Data

(60) Provisional application No. 61/016,867, filed on Dec. 27, 2007.

(51) Int. Cl.
*E21B 43/267* (2006.01)

(52) U.S. Cl. ..... 166/280.1; 166/283; 166/308.3

(58) Field of Classification Search ..... None
See application file for complete search history.

(56) References Cited

U.S. PATENT DOCUMENTS 2,033,562 A 7/1934 Wells
3,687,203 A * 8/1972 Malone ..... 166/308.1
3,800,847 A 4/1974 Rike

FOREIGN PATENT DOCUMENTS

EP 1447523 A1 8/2004

* cited by examiner

*Primary Examiner*—Zakiya W. Bates
(74) *Attorney, Agent, or Firm*—Trop, Pruner & Hu, P.C.; Cuong L. Nguyen

(57) ABSTRACT

A technique includes running a string into a well bore and inhibiting formation face failure. The well bore extends at least partially through a non-producing layer and a hydrocarbon formation layer. The inhibiting of the formation face failure includes communicating a proppant into the well bore via the string until a well bore pressure exceeds a first formation stress of the non-producing layer, which causes a fracture to form in the non-producing layer, and communicating the proppant into the fracture to create a barrier layer.

16 Claims, 5 Drawing Sheets

400

| SIZE RANGE (METRIC) | SIZE RANGE (APPROX. INCHES) | AGGREGATE NAME (WENTWORTH CLASS) |
|---|---|---|
| 4-8 mm | 0.157-0.31 in | FINE GRAVEL |
| 2-4 mm | 0.079-0.157 in | VERY FINE GRAVEL |
| 1-2 mm | 0.039-0.079 in | VERY COARSE SAND |
| 1/2-1 mm | 0.020-0.039 in | COARSE SAND |
| 1/4-1/2 mm | 0.010-0.020 in | MEDIUM SAND |
| 125-250 $\mu$m | 0.0049-0.010 in | FINE SAND |
| 62.5-125 $\mu$m | 0.0025-0.0049 in | VERY FINE SAND |
| 3.90625-62.5 $\mu$m | 0.00015-0.0025 in | SILT |
| < 3.90625 $\mu$m | < 0.00015 in | CLAY |
| < 1 $\mu$m | < 0.000039 in | COLLOID |

SILTSTONE 420

SANDSTONE 410

INHIBITING FORMATION FACE FAILURE IN OIL AND GAS WELLS

This application claims the benefit under 35 U.S.C. §119 (e) to U.S. Provisional Patent Application Ser. No. 61/016,867, entitled, "EXTENSION OF SAND CONTROL METHOD TO INCLUDE NON-SAND FORMATION IN OIL AND GAS WELLS," which was filed on Dec. 27, 2007, and is hereby incorporated by reference in its entirety.

BACKGROUND

The invention generally relates to inhibiting formation face failure in oil and gas wells.

In well drilling, artificial lift describes the process for using artificial means to increase the flow of liquids, such as crude oil or water, to the surface of a production well. Artificial lift is usually provided by providing a pressure gradient within the reservoir, thereby encouraging the flow of reservoir fluids to the producing well bore.

Artificial lift can be provided by an electric submersible pump (ESP). An electric submersible pump has a hermetically sealed motor close-coupled to the pump body. The pump assembly is submerged in the reservoir fluid. Reservoir fluids are then drawn into the electric submersible pump, and are pumped up the well bore for collection. The electric submersible pump can provide a significant lifting force since it does not rely on external air pressure to lift the fluid.

Artificial lift is provided in many working reservoirs by electric submersible pumps, lifting from shale inter-bedded sandstone sequence, such as that found in the Forties Field of the North Sea. The working life of the electric submersible pump can be adversely affected in fields, such as the Forties Field where sandface failures are common. In these types of fields, run times for the electric submersible pumps have fanged from several days, to several years, depending on the frequency of the sandface failures.

Pump failure is sometimes attributed to electrical insulation failure, such as the cables, windings, and ingress of fluids to the electrical motor. However, more often, electric submersible pumps fail due to mechanical failure of the pump, such as a seized shaft, seal failure, or pack off of the pump impellers. These mechanical failures are often caused by the operating environment. For example, solid contaminants within the flow stream may cause abrasion of the mechanical pump parts. This abrasion may result in a failure of the pump. Failure of the sandface is a major producer of these contaminants.

SUMMARY

In an embodiment of the invention, a technique includes running a string into a well bore and inhibiting formation face failure. The well bore extends at least partially through a non-producing layer and a hydrocarbon formation layer. The inhibiting of the formation face failure includes communicating a proppant into the well bore via the string until a well bore pressure exceeds a first formation stress of the non-producing layer, which causes a fracture to form in the non-producing layer, and communicating the proppant into the fracture to create a barrier layer to prevent the formation face failure.

In another embodiment of the invention, a technique to manage a well site includes determining an intervention for a well at the well site and applying the intervention to the well. The technique includes managing the well site, including running a string into a well bore of the well. The well bore at least partially extends through a non-producing layer and a hydrocarbon formation layer. The management of the well site includes inhibiting formation face failure, which includes communicating a proppant into the well bore via the string until a well bore pressure exceeds a first formation stress of the non-producing layer, causing a fracture to form in the non-producing layer, and communicating the proppant into the fracture to create a barrier layer to prevent the formation face failure.

In yet another embodiment of the invention, a system includes a well bore and a barrier layer that contains a proppant. The well bore extends through a hydrocarbon formation layer and a non-producing layer. The barrier layer is disposed between the well bore and the non-producing layer and inhibits formation face failure.

Advantages and other features of the invention will become apparent from the following drawing, description and claims.

DETAILED DESCRIPTION

Figure 1:
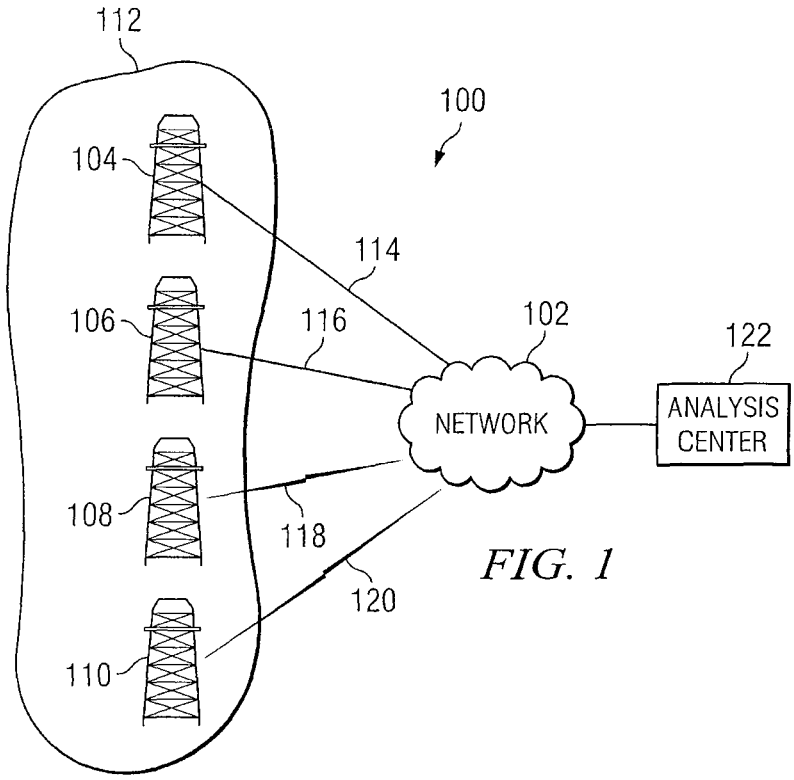
FIG. 1 is a pictorial representation of a network data processing system according to an embodiment of the invention.

With reference now to FIG. 1, a pictorial representation of a network data processing system is depicted in which a preferred embodiment of the present invention may be implemented. In this example, network data processing system 100 is a network of computing devices in which different embodiments of the present invention may be implemented. Network data processing system 100 in these examples is used to collect data, analyze data, and make decisions with respect to the life cycle of different natural resources, such as oil and gas. Different stages in this life cycle include exploration, appraisal, reservoir development, production decline, and abandonment of the reservoir. In these different phases, network data processing system 100 is used to make decisions to properly allocate resources to assure that the reservoir meets its production potential.

Network data processing system 100 includes network 102, which is a medium used to provide communications links between various devices and computers in communication with each other within network data processing system 100. Network 102 may include connections, such as wire, wireless communications links, or fiber optic cables. The data could even be delivered by hand with the data being stored on a storage device, such as a hard disk drive, DVD, or flash memory.

In this depicted example, well sites 104, 106, 108, and 110 have computers or other computing devices that produce data regarding wells located at these well sites. In these examples, well sites 104, 106, 108, and 110 are located in geographic region b. This geographic region is a single reservoir in these examples. Of course, these well sites may be distributed across diverse geographic regions and/or over multiple reservoirs, depending on the particular implementation. These well sites may be well sites that are being developed or ones in which production are occurring. In these examples, well sites 104 and 106 have wired communications links 114 and 116 to network 102. Well sites 108 and 110 have wireless communications links 118 and 120 to network 102.

Analysis center 122 is a location at which data processing systems, such as servers are located to process data collected from well sites 104, 106, 108, and 110. Of course, depending on the particular implementation, multiple analysis centers may be present. These analysis centers may be, for example, at an office or an on-site in geographic region 112 depending on the particular implementation. In these illustrative embodiments, analysis center 122 analyzes data from well sites 104, 106, 108, and 110 using processes for different embodiments of the present invention.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for different embodiments.

Figure 2:
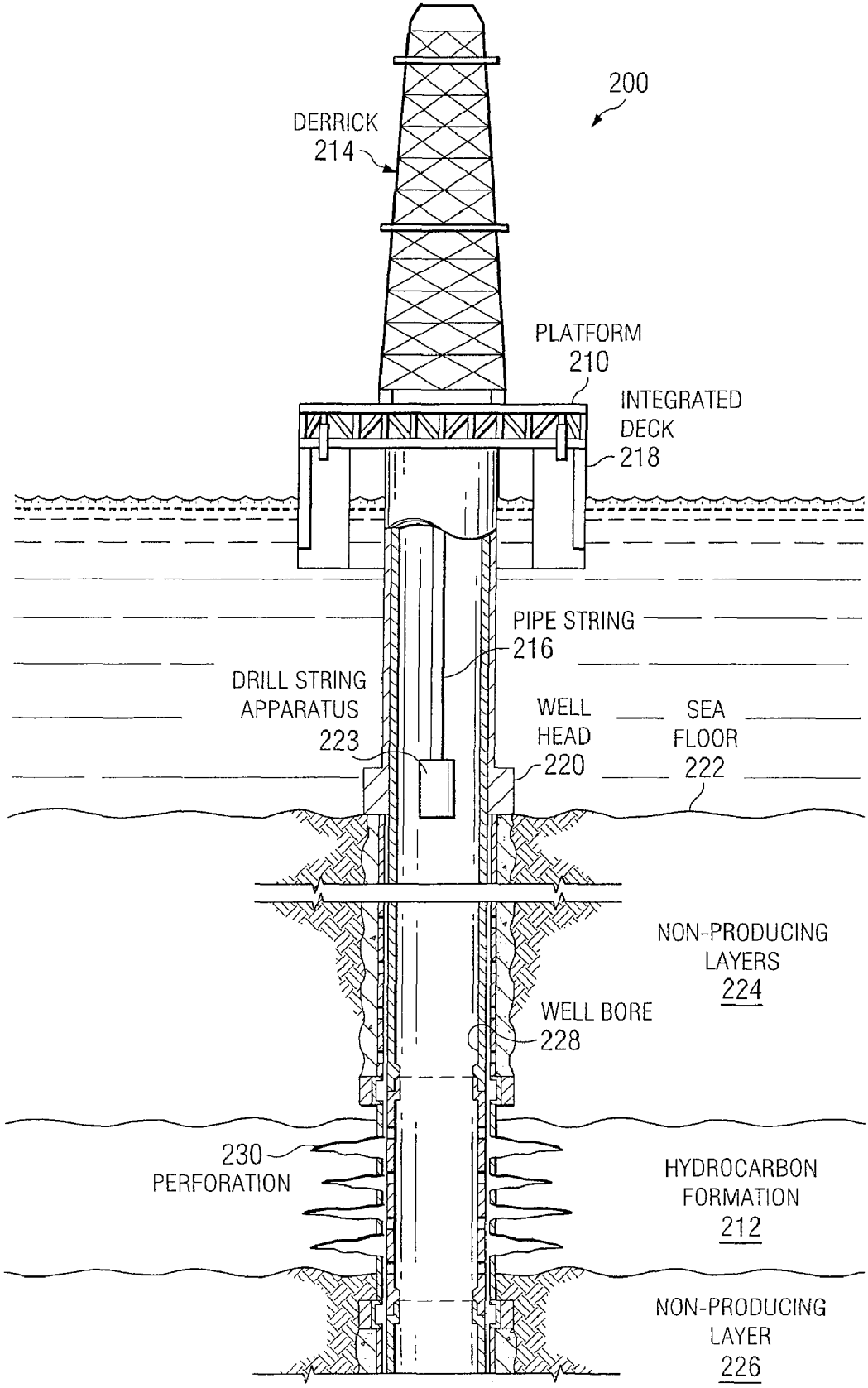
FIG. 2 is a diagram of an offshore oil and gas platform connected to a hydrocarbon producing well according to an embodiment of the invention.

Referring now to FIG. 2, an exemplary well site 200 includes an oil and gas platform 210 and well sites 104, 106, 108, and 110. Although a subsea well is specifically described below for purposes of example, it is understood that the systems and techniques that are described herein may likewise be applied to land-based wells, in accordance with other embodiments of the invention.

Platform 210 is positioned over hydrocarbon formation 212. Hydrocarbon formation 212 is a formation of sandstone, or other permeable material, containing hydrocarbons, such as oil and natural gas, interspersed within the rock matrix.

Derrick 214 is used to install pipe string 216 from integrated deck 218 to well head 220 situated on sea floor 222. In addition to installing pipe string 216, derrick 214 can also be used to convey drill string apparatuses 223 down pipe string 216 and within well bore 228.

Drill string apparatuses 223, including monitoring and intervention type apparatuses, can be used to measure properties of hydrocarbon formation 212, as well as non-producing layer 224 and non-producing layer 226 adjacent to hydrocarbon formation 212 and surrounding well bore 228. Drill string apparatuses 223 may also be used to provide intervention to well bore 228 and hydrocarbon formation 212. In undersea operations, such as shown in well site 200, non-producing layer 224 and non-producing layer 226 may be largely formed from shale or siltstone. An intervention is a remedial measure applied to a well bore, which is aimed at improving production therein.

Well bore 228 extends from wellhead 220, below sea floor 222. Well bore 228 traverses through non-producing layer 224 and into hydrocarbon formation 212. Depending on the particular embodiment of the invention, well bore 228 may or may not be lined with a metal or cement casing to support well bore 228 and thus, stabilize the recently drilled formation.

Perforation 230 is punctured through well bore 228, including any casing therein, and extends from well bore 228 into hydrocarbon formation 212. Perforation 230 is a series of tunnels that are formed by (as non-limiting examples) punching, jetting or shaped-charge jets. The tunnels extend though the casing or liner of well bore 228 and into hydrocarbon formation 212 to hydraulically connect well bore 228 to hydrocarbon formation 212. Perforation 230 allows hydrocarbons from hydrocarbon formation 212 to flow into well bore 228. Perforation 230 also provides a conduit from well bore 228 to provide any intervention, such as hydraulic fracturing, gravel packing, or fracturing packing to hydrocarbon formation 212.

Perforation 230 may be formed in a prior downhole run using a shaped charge perforating gun, a jetting tool or any other type of perforating device.

Figure 3:
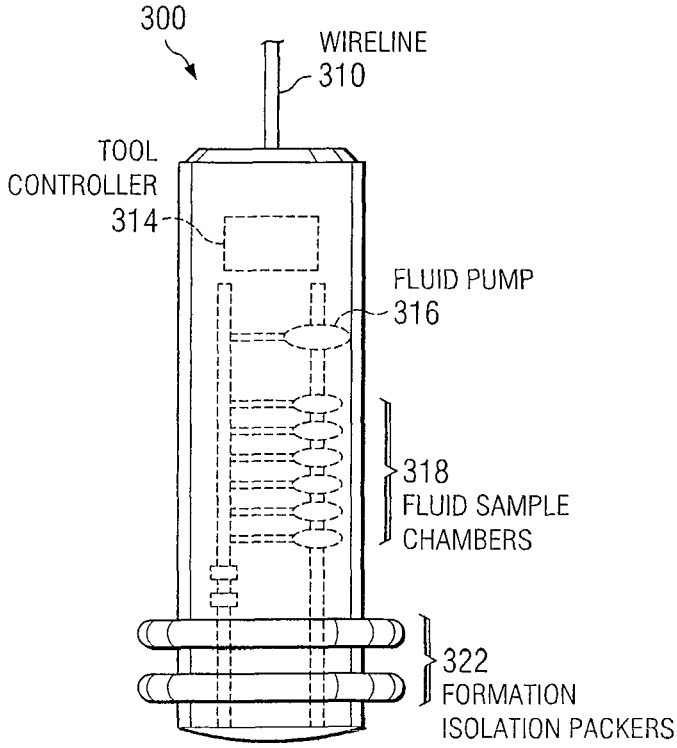
FIG. 3 is a schematic diagram of a drill string apparatus used to provide fracture packing intervention to areas surrounding a perforated well bore according to an embodiment of the invention.

Referring now to FIG. 3, a diagram illustrating an exemplary drill string apparatus used to provide fracture packing intervention to areas surrounding the perforated well bore is shown according to an embodiment of the invention. Drill string apparatus 300 can be a drill string apparatus, such as drill string apparatus 223 of FIG. 2, to provide fracture packing intervention to a hydrocarbon formation, such as hydrocarbon formation 212 of FIG. 2. Drill string apparatus 300 includes one or more assemblies for performing perforation or packing of an intervention in the well bore. As a non-limiting example, drill string apparatus 300 may be a QUANTUM gravel pack system, available from Schlumberger Limited.

As a non-limiting example, the drill string apparatus 300 may be run downhole in the well bore 228 by a wire line 310, which may include a single strand, multiple strands, or braided strands of metal wire. Wire line 310 is capable of conducting an electrical circuit to drill string apparatus 300 and is also capable of providing a communications pathway between drill string apparatus 300 and any monitoring computers receiving the well bore data. It is noted that the wire line 310 is only one example of a conveyance device, as another type of conveyance device (such as jointed tubing, a slickline, coiled tubing, etc., as non-limiting examples) may be used to run the drill string 300 downhole, in accordance with other embodiments of the invention.

Tool controller 314 provides instructions received from the control computer to other components of formation evaluation tool 300. Tool controller 314 can be a data processing system, including software instructions, which provides control instructions to drill string apparatus 300.

Fluid pump 316 pumps fluid into the bore hole and into fluid sample chambers 318 and formation isolation packers 322. Fluid pump 316 may also include valves or ports that may be opened and closed from the surface of drill string apparatus 300 in order to introduce fluids into fluid sample chambers 318 or formation isolation packers 322.

Formation isolation packers 322 are inflatable annular rings disposed around the outer surface of drill string apparatus 300. Formation isolation packers 322 are adapted for sealingly engaging the well bore. Formation isolation packers 322 are typically made of a thermoplastic elastomer, such as rubber. Fluid sample chambers 318 provide a channel by which formation fluids can be pumped from fluid pump 316 into the interior of formation isolation packers 322, causing formation isolation packers 322 to inflate and engage the sides of the well bore. Formation isolation packers 322 thus provide a seal such that the conditions in an area between formation isolation packers 322 can be changed, for instance by altering the pressure within this area, relative to the conditions elsewhere in the well bore.

During a hydraulic fracturing process, the pressure in a well bore is increased by the pumping of fluids into the well bore. The fluid can be any number of fluids, ranging from water to gels, foams, nitrogen, carbon dioxide or even air in some cases. When the pressure within the well bore exceeds the formation stress of the formation, a fracture within the formation is caused to open, thereby relieving some of the pressure. The fracture extends away from the well bore according to the natural stresses within the formation. The fracture can be maintained in an opened position by pumping proppant into the opened fracture to prevent closing of the fracture when pressure within the well bore is reduced. A proppant is a porous media, such as sand, that is pumped into a fracture in order to maintain the fracture in an expanded state when the pressure in the well bore is decreased.

Proppants are dissolved or otherwise carried in specially engineered fluids pumped at high pressure and rate into the reservoir interval to be treated. The proppant, which is commonly sieved round sand, is carried into the fracture. This sand is chosen to be higher in permeability than the surrounding formation and the propped hydraulic fracture then becomes a high permeability conduit through which the formation fluids can be produced back to the well. Various types of proppants are used, including sand, resin-coated sand, and man-made ceramics depending on the type of permeability or grain strength needed.

When formation isolation packers 322 are set into place, drill string apparatus 300 provides fracturing and fracture packing to the hydrocarbon formation, such as hydrocarbon formation 212 of FIG. 2. The proppant slurry is pumped into the casing or screen annulus via a circulation housing located in the extension below the packer.

In a fracture packing operation, the proppant slurry is pumped into the well bore until the pressure within the well bore exceeds the formation stress. When a fracture within the formation is caused to open, the proppant slurry is forced into the formation. The proppant filled fracture facilitates flow of hydrocarbons from the formation into the well bore.

Figures 4, 5:
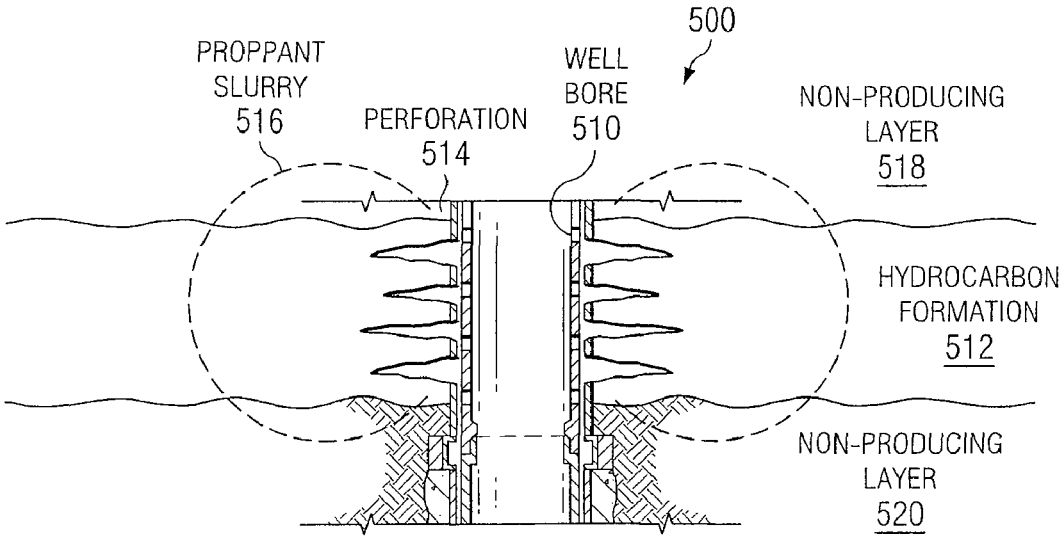
FIG. 5 (PRIOR ART)
FIG. 4 is a table illustrating a classifying of clastic rocks according to the diameter of individual grains of sediment within the rock.
FIG. 5 is a schematic diagram of a fracture packing intervention of the prior art.

Referring now to FIG. 4, a table is shown classifying clastic rocks according to the diameter of individual grains of sediment within the rock. In table 400, size ranges define limits of classes that are given names in the Wentworth scale to classify the clastic rocks and formations made therefrom.

According to the Wentworth scale depicted in FIG. 4, sandstone 410 typically has a particle size of from about 0.0063 millimeters to about 1.0 millimeters in diameter. Siltstones 420 and shales on the other hand typically have a particle size of from about 3.9 micrometers (0.0004 millimeters) to about 63 micrometers (0.0063 millimeters). The smaller particle size in the siltstone and shale result in less interstitial space between neighboring particles. The limited interstitial space effectively precludes any hydrocarbons from being located within the siltstone and shale. Larger sandstone particles result in larger interstitial spaces, in which hydrocarbons can be found.

Referring now to FIG. 5, a schematic diagram of a fracture packing intervention applied to a well bore is shown according to the prior art. Well bore 510, which can be well bore 228 of FIG. 2, extends through hydrocarbon formation 512, which can be hydrocarbon formation 212 of FIG. 2. Perforation 514 may be perforation 230 of FIG. 2. This perforation connects well bore 510 to hydrocarbon formation 512.

Proppant slurry 516 is pumped into well bore 510 from a drill string apparatus, such as drill string apparatus 300 of FIG. 3. Proppant slurry 516 is pumped into well bore 510 until the pressure within well bore 510 exceeds the formation stress. When a fracture within the formation opens or occurs, the proppant slurry is forced into the formation through the fracture. The proppant filled fracture facilitates flow of hydrocarbons from the formation into the well bore.

Perforation 514 is typically located within hydrocarbon formation 512, to provide a ready conduit for hydrocarbons to flow from hydrocarbon formation 512 into well bore 510 where the hydrocarbons can be extracted. Because perforation 514 is localized within hydrocarbon formation 512, proppant slurry 516 is typically maintained within hydrocarbon formation 512, and does not flow into non-producing layer 518 and non-producing layer 520 that sandwich the hydrocarbon formation 512. Non-producing layer 518 and non-producing layer 520 may be formed primarily of shale or siltstone.

As hydrocarbons are extracted from hydrocarbon formation 512, changes in pore pressure directly affect the horizontal stress. Pore pressure is the internal pressure of a certain layer of the formation. Pore pressure is dependent upon the concentration of fluids within the formation layer. For a relaxed basin where the overburden dominates the stress field, the horizontal stresses in non-producing layer 518 and non-producing layer 520 are dependent on the overburden, the Poisson's Ratio, and the current pore pressure according to Equation 1:

$$\sigma_h = \frac{1}{1-v}(\sigma_v - \alpha p) + \alpha p, \qquad \text{Equation 1}$$

where:

$\sigma_h$=the horizontal stress;

$\sigma_v$=the vertical stress;

v=the Poisson's ratio;

$\alpha$=the overburden; and p=the pore pressure.

The stress in each layer, including hydrocarbon formation 512, non-producing layer 518 and non-producing layer 520 can then be calculated based upon the Poisson's Ratio, and then adjust this stress for depletion. The reduction in stress within hydrocarbon formation 512—often due to a production withdrawal of hydrocarbons—leads directly to an increase in horizontal stress within the adjacent, low permeability non-producing layer 518 and non-producing layer 520. This increase in horizontal stress is due to a static force equilibrium shift from the decreased pressure within hydrocarbon formation 512. The horizontal stress reduction in the hydrocarbon layer and the horizontal stress increase in the non-producing layers create a stress discrepancy.

Figure 6:
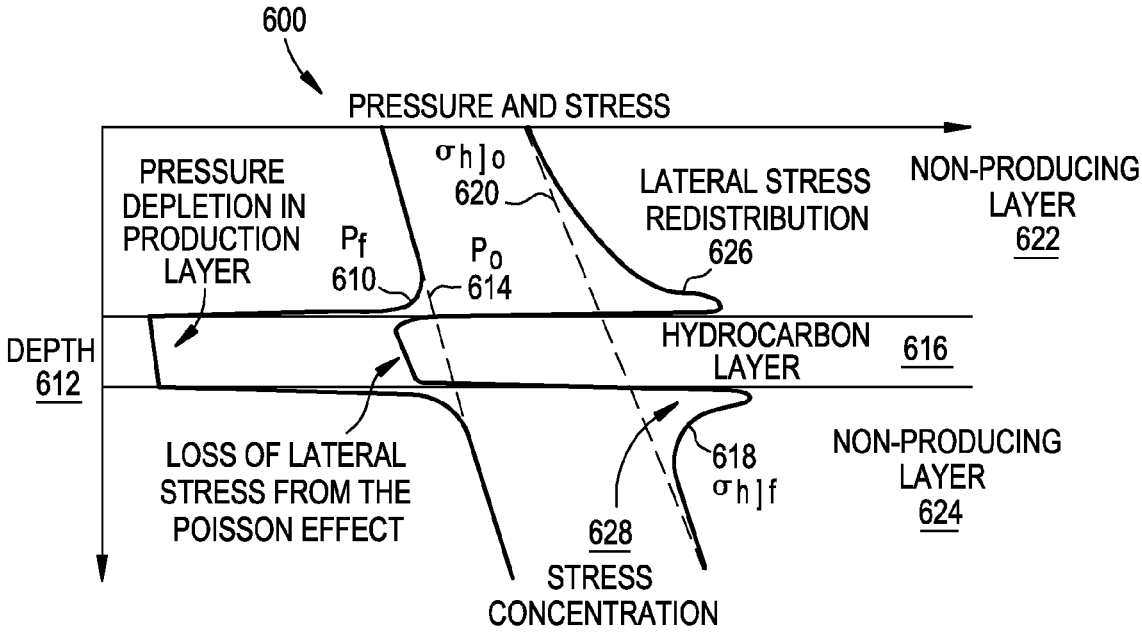
FIG. 6 is a cross sectional illustration of a pressure profile according to an embodiment of the invention.

Referring now to FIG. 6, a cross sectional illustration of a pressure profile is shown. The pressure profile of FIG. 6 is obtained as formation fluids are removed from the hydrocarbon layer 616, which can be hydrocarbon formation 512 of FIG. 5.

Formation pressure $P_f$ 610 typically increases with the depth 612 of the formation. However, formation pressure $P_f$ 610 deviates significantly from predicted formation pressure $P_o$ 614 in an area of hydrocarbon layer 616, which can be a production formation in a reservoir. Because formation fluids have been withdrawn from hydrocarbon layer 616, formation pressure $P_f$ 610 has been decreased significantly from predicted formation pressure $P_o$ 614.

Lateral stress $O_{hf}$ 618, similar to formation pressure $P_f$ 610, also typically increases with the depth 612 of the formation. Lateral stress $O_{hf}$ 618 deviates significantly from the predicted lateral stress $O_{ho}$ 620. In hydrocarbon layer 616, lateral stress $O_{hf}$ 618 experiences a stress reduction due to the withdrawn formation fluids. However, in order to maintain static force equilibrium, lateral stress $O_{hf}$ 618 in surrounding non-producing layer 622 and non-producing layer 624 will experience a corresponding pressure increase. These stress increases can be seen at lateral stress redistribution 626 and stress concentration 628.

The overall result when considering a reservoir with depletion is that the stress contrast between hydrocarbon layer 616, non-producing layer 622, and non-producing layer 624 is increased due to stress changes between the media. The net result is twofold: first, hydraulic fractures are more vertically confined and hence longer. Second, any open hole or perforated shale or siltstone is more liable to destabilize, especially at low bottom hole pressure, such as when approaching a depleted layer with a drill bit or operating an electric submersible pump completion.

Thus, lateral stress redistribution 626 and stress concentration 628 in the surrounding non-producing layer 622 and non-producing layer 624 can lead to sandface failure in those areas. This formation face failure can lead to an overproduction of sand contaminants, which adversely affects the pump life of the electric submersible pumps providing artificial lift to the reservoir. When contaminants are overproduced, the contaminants can find their way into the electric submersible pump, and cause mechanical failure of the pump.

In accordance with embodiments of the invention, an intervention is used to prevent fine material from being removed from the formation face due to formation face failure. The intervention should prevent future plugging of electric submersible pumps. The intervention would also prevent local destabilization of the sands at the perforation due to the removal of supporting adjacent material.

Figure 7:
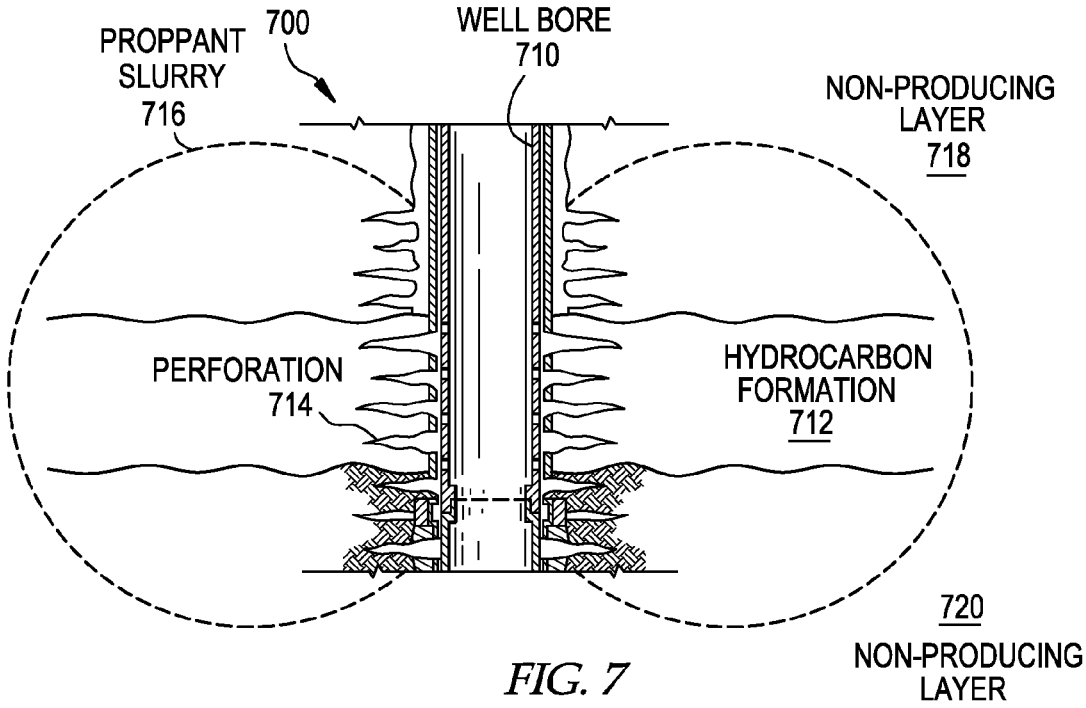
FIG. 7 is a schematic diagram of a fracture packing intervention according to an embodiment of the invention.

Referring now to FIG. 7, a schematic diagram of a fracture packing intervention applied to a well bore is shown according to an embodiment of the invention. Well bore 710, which can be well bore 228 of FIG. 2, extends through upper non-producing layer 716, hydrocarbon formation 712 and lower non-producing layer 718. The hydrocarbon formation layer 712 may be hydrocarbon formation 212 of FIG. 2. Perforation 714, which can be perforation 230 of FIG. 2, connects well bore 710 to hydrocarbon formation 712.

Proppant slurry 716 is pumped into well bore 710 from a drill string apparatus, such as drill string apparatus 300 of FIG. 3. Proppant slurry 716 is pumped into well bore 710 until the pressure within well bore 710 exceeds the formation stress. When a fracture within the formation is caused to open, the proppant slurry is forced into the formation. The proppant filled fracture facilitates flow of hydrocarbons from the formation into the well bore.

Perforation 714 is extended from their typical location within hydrocarbon formation 712 to include perforation 714 into non-producing layer 718 and non-producing layer 720 that sandwich the hydrocarbon formation 712. Proppant slurry 716 is pumped into hydrocarbon formation 712 to provide a ready conduit for hydrocarbons to flow from hydrocarbon formation 712 into well bore 710 where they can be extracted. Furthermore, proppant slurry 716 is pumped into surrounding non-producing layer 718 and non-producing layer 720 to provide structural support to those areas during extraction of hydrocarbons from hydrocarbon formation 712. By providing proppant slurry 716 to surrounding non-producing layer 718 and non-producing layer 720, a barrier is created between the surrounding non-producing layer 718 and non-producing layer 720, thereby reducing erosion of the sandface due to the static equilibrium shift caused by removal of hydrocarbons from hydrocarbon formation 712. The barrier layer is an amalgamated conglomeration of the proppant slurry and the surrounding rock matrix which is more resistant to erosion than is the rock matrix of the well bore without the proppant.

Figure 8:
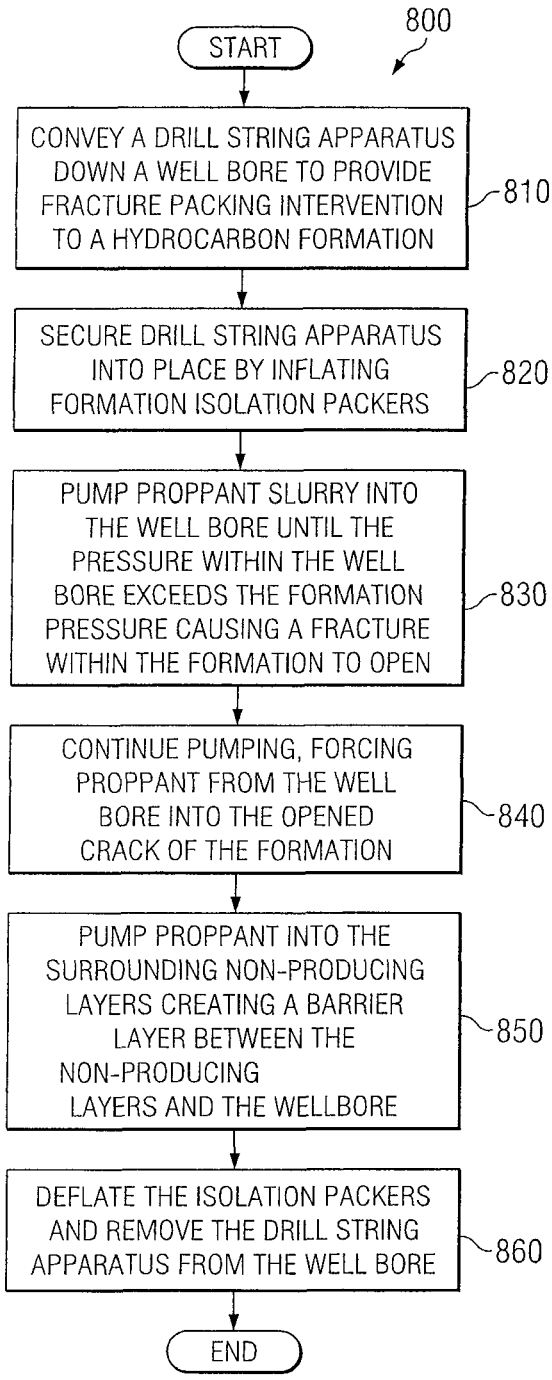
FIG. 8 is a flow diagram of a fracture packing technique according to an embodiment of the invention.

Referring now to FIG. 8, a fracture packing intervention technique 800 may be performed according to an embodiment of the invention. Before the technique 800 commences, at least one operation (a logging operation, for example) has been conducted for purposes of identifying the locations and thus, the boundaries of hydrocarbon formation layers (i.e., producing layers) and nearly non-producing layers.

The technique 800 includes conveying (block 810) a drill string apparatus down a well bore to provide fracture packing intervention to a hydrocarbon formation. The drill string apparatus may contain one or more assemblies for performing perforation or packing intervention in the well bore and may be the drill string apparatus 300 of FIG. 3. The drill string apparatus can be a QUANTUM gravel pack system, available from Schlumberger. In other embodiments of the invention, the perforating may be performed, for example, in a prior a run into the well using a perforating string.

The drill string apparatus is run downhole and positioned to target a producing layer and at least one non-producing layer. The drill string apparatus is secured into place by inflating formation isolation packers, pursuant to block 820. The formation isolation packers are adapted for sealingly engaging the well bore. The formation isolation packers can be formation isolation packers 322 of FIG. 3. The formation isolation packers are typically made of a thermoplastic elastomer, such as rubber. Fluid sample chambers provide a channel by which formation fluids can be pumped from fluid pump into the interior of the formation isolation packers, causing the formation isolation packers to inflate and engage the sides of the well bore.

The formation isolation packers provide a seal such that the conditions in an area between formation isolation packers 322 can be changed, for instance by altering the pressure within this area, relative to the conditions elsewhere in the well bore.

The technique 800 including pumping (block 830) proppant slurry into the well bore until the pressure within the well bore exceeds the formation stress, causing at least one fracture within the formation to open and, in accordance with embodiments of the invention, at least one fracture in the non-producing layer to open. The fractures extend away from the well bore according to the natural stresses within the formation.

The pumping continues, pursuant to block 840, to force proppant from the well bore into the opened cracks of the formation and non-producing layers. Proppant is forced into both the sandstone hydrocarbon formation, as well as the surrounding, non-producing siltstone and shale layers.

Proppant pumped into the surrounding non-producing layers, creates a barrier between the non-producing sandstone layers and the well bore, pursuant to block 850. The barrier layer is more erosion resistant than the natural sandstone. The barrier layer is a amalgamated conglomeration of the proppant slurry and the surrounding rock matrix which is more resistant to erosion than is the rock matrix of the well bore without the proppant. The reservoir therefore experiences less erosion when the barrier layer is in place.

When pumping of proppant is complete, the technique 800 includes deflating (block 860) the isolation packers, and removing (block 860) the drill string apparatus from the well bore, with the process terminating thereafter. Excess proppant is removed along with the drill string apparatus.

It is noted that the isolation packer may be retracted, the string may be repositioned and the isolation packers may be re-inflated during the course of the fracturing and proppant delivery operation, in accordance with embodiments of the invention. Thus, many variations are contemplated and are within the scope of the appended claims.

Figure 9:
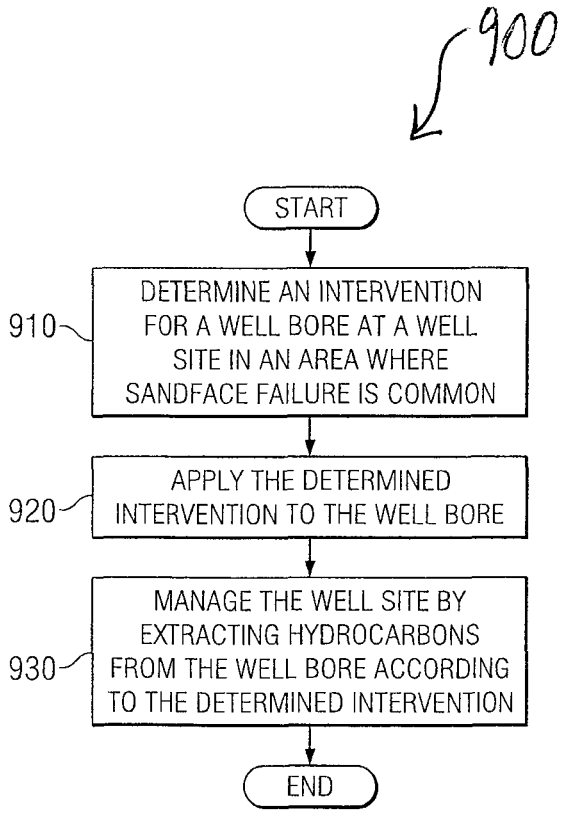
FIG. 9 is a flow diagram of a well site according to an embodiment of the invention.

Referring now to FIG. 9, a flowchart depicting a technique 900 to manage a well site is shown according to an embodiment of the invention. The technique 900 includes determining (block 910) an intervention for a well bore at a well site in an area where sandface failure is common. The intervention can provide a fracture packing proppant to the well bore, as shown in FIG. 7. The well site can be well site 200 of FIG. 2.

The intervention is then applied to the well bore, pursuant to block 920. According to the intervention, proppant is pumped into the well bore until the pressure within the well bore exceeds the formation stress, causing one or more fractures to extend into the formation into non-producing and producing layers. The fracture(s) extend away from the well bore according to the natural stresses within the formation. Pumping of the proppant continues until the proppant is forced from the well bore into the opened fracture(s) of the formation. Proppant is forced into both the sandstone hydrocarbon formation, as well as the surrounding, non-producing siltstone and shale layers. Proppant pumped into the surrounding non-producing layers, creates a barrier between the non-producing sandstone layers and the well bore. The barrier layer is more erosion resistant than the natural sandstone. The reservoir therefore experiences less erosion when the barrier layer is in place. The barrier layer is an amalgamated conglomeration of the proppant slurry and the surrounding rock matrix which is more resistant to erosion than is the rock matrix of the well bore without the proppant.

The technique 900 includes managing (block 930) the well site by extracting hydrocarbons from the well bore with the technique 900 terminating thereafter.

Other embodiments are contemplated and are within the scope of the appended claims. For example, in accordance with other embodiments of the invention, the hydrocarbon producing and non-producing layers may be interleaved. As another example, in accordance with other embodiments of the invention, the hydrocarbon producing formation may be a formation other than a sandstone formation and thus, the techniques and systems that are disclosed herein may inhibit a formation face failure other than a sandface failure.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

running a string into a well bore, the well bore extending at least partially through a non-producing layer, and a hydrocarbon formation layer; and inhibiting formation face failure, comprising:

communicating a proppant into the well bore via the string until a well bore pressure exceeds a first formation stress of the non-producing layer, causing a fracture to form in the non-producing layer; and communicating the proppant into the fracture to create a barrier layer between the well bore and the non-producing layer to prevent formation face failure due to reduction of pressure in the hydrocarbon formation layer caused by production.

2. The method of claim 1 further comprising:

communicating the proppant from the string into the well bore until the well bore pressure exceeds a second formation stress of the hydrocarbon formation layer, causing another fracture to open in the hydrocarbon formation layer; and pumping the proppant into said another fracture.

3. The method of claim 1, wherein the non-producing layer comprises a siltstone layer, the siltstone layer having an average particle size diameter of from about 3.9 micrometers to about 63 micrometers.

4. The method of claim 3, wherein the hydrocarbon formation layer comprises a sandstone layer, the sandstone layer having an average particle size diameter from about 0.0063 millimeters to about 1.0 millimeters.

5. The method of claim 3, wherein the fracture comprises interstitial spaces between particles of the siltstone layer.

6. The method of claim 1, wherein the hydrocarbon formation layer comprises a sandstone layer, the sandstone layer having an average particle size diameter of from about 0.0063 millimeters to about 1.0 millimeters.

7. The method of claim 1, wherein the barrier layer comprises a conglomeration of the proppant slurry and a surrounding rock matrix of the well bore.

8. The method of claim 1, wherein the string comprises a drill string.

9. The method of claim 1, further comprising:

identifying locations of the non-producing and hydrocarbon formation layers; and regulating placement of the string based on the identified locations.

10. The method of claim 1, wherein the formation face failure comprises sand face failure.

11. A method usable with a well, comprising:

determining an intervention for the well at the well site;

applying the intervention to the well; and managing the well site, comprising:

running a string into a well bore of the well, the well bore at least partially extending through a non-producing layer, and a hydrocarbon formation layer; and inhibiting formation face failure, comprising:

communicating a proppant into the well bore via the string until a well bore pressure exceeds a first formation stress of the non-producing layer, causing a fracture to form in the non-producing layer; and communicating the proppant into the fracture to create a barrier layer between the well bore and the non-producing layer to prevent formation face failure due to reduction of pressure in the hydrocarbon formation layer caused by production.

12. The method of claim 11, further comprising:

communicating the proppant from the string into the well bore until the well bore pressure exceeds a second formation stress of the hydrocarbon formation layer, causing another fracture to open in the hydrocarbon formation layer; and pumping the proppant into said another fracture.

13. The method of claim 11, wherein the non-producing layer comprises a siltstone layer, the siltstone layer having an average particle size diameter of from about 3.9 micrometers to about 63 micrometers.

14. The method of claim 11, wherein the hydrocarbon formation layer comprises a sandstone layer, the sandstone layer having an average particle size diameter of from about 0.0063 millimeters to about 1.0 millimeters.

15. The method of claim 11, further comprising:

identifying locations of the non-producing and hydrocarbon formation layers; and regulating placement of the string based on the identified locations.

16. The method of claim 11, wherein the formation face failure comprises sand face failure.

* * * * *